US005313813A

United States Patent [19]

Heitze et al.

[11] Patent Number: 5,313,813

[45] Date of Patent: May 24, 1994

[54] UPSETTING PRESS FOR REDUCING THE WIDTH OF ROLLNG STOCK WITH INTERNALLY COOLED RETAINING ROLLS AND DRIVER ROLLS

[75] Inventors: Gerhard Heitze, Netphen; Ulrich Meinhardt, Hilchenbach, both of Fed. Rep. of Germany

[73] Assignee: SMS Schloemann-Siemag Aktiengesellschaft, Düsseldorf, Fed. Rep. of Germany

[21] Appl. No.: 951,376

[22] Filed: Sep. 25, 1992

Related U.S. Application Data

[63] Continuation of Ser. No. 744,458, Aug. 12, 1991, abandoned.

[30] Foreign Application Priority Data

Aug. 10, 1990 [DE] Fed. Rep. of Germany ..... 4025389

[51] Int. Cl.[5] ..... B21B 27/08

[52] U.S. Cl. ..... 72/201; 70/206; 164/448; 492/46

[58] Field of Search ..... 72/200, 201, 206; 29/110, 116.1, 129.5; 164/348, 356, 442, 448; 165/89, 90; 492/46

[56] References Cited

U.S. PATENT DOCUMENTS

| | | | |
|---|---|---|---|
| 3,446,275 | 5/1969 | Kurokawa et al. | 165/90 |
| 3,604,237 | 9/1971 | Kawanami et al. | 165/89 |
| 4,280,552 | 7/1981 | Bayer et al. | 164/448 |
| 4,442,883 | 4/1984 | Yamakami et al. | 164/442 |
| 4,478,247 | 10/1984 | Alber | 165/89 |
| 4,506,727 | 3/1985 | Swasey | 165/90 |
| 4,603,729 | 8/1986 | Kawaguchi et al. | 164/442 |
| 5,094,094 | 3/1992 | Muramatsu et al. | 29/527.7 |

FOREIGN PATENT DOCUMENTS

| | | | |
|---|---|---|---|
| 0112516 | 5/1988 | European Pat. Off. . | |
| 683932 | 11/1939 | Fed. Rep. of Germany . | |
| 0121001 | 6/1985 | Japan | 72/206 |
| 0192401 | 8/1989 | Japan | 72/206 |
| 0317603 | 12/1989 | Japan | 72/206 |

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

In an upsetting press for reducing the width of rolling stock, particularly for reducing the slab width in hot-rolled wide strip roughing mills with tool carriers, which are disposed on either side of the slab edge and accommodate pressing tools, in order to improve the pressing process, the upsetting press has, in the region between the pressing tools, at least one height-adjustable retaining roll above and at least one below the slab, that driver rolls are disposed in the inlet and outlet regions of the upsetting press above and below the slab and the retaining rolls and driver rolls are provided with internal cooling.

1 Claim, 3 Drawing Sheets

UPSETTING PRESS FOR REDUCING THE WIDTH OF ROLLNG STOCK WITH INTERNALLY COOLED RETAINING ROLLS AND DRIVER ROLLS

This is a continuation application of Ser. No. 07/744,458, filed Aug. 12, 1991, now abandoned.

FIELD OF INVENTION

The invention relates to an upsetting press for reducing the width of rolling stock, particularly for reducing the slab width in hot-rolled wide strip roughing mills with tool carriers, which are disposed on either side of the slab edge and accommodate pressing tools.

An upsetting press of the type named above is known, for example, from the European patent 0 112 516 and comprises a pair of pressing tools, which are disposed on both sides of a slab feed line, so that their pressing surfaces for pressing a slab point towards one another. A vibrating unit causes the press tools to vibrate. This known upsetting press furthermore comprises a width control unit for controlling the position of the press tool in the width direction of the slab, and a control unit which detects that the front end of the slab is disposed between the parallel surfaces of the press tools and which then puts into operation the width control device and, after a specified pressing has been carried out, the vibrating unit. This press is intended to improve the upsetting effect with respect to the shape and surface of the slab. Whether the slab is held in its position in the upsetting press during the horizontal upsetting by vertically acting devices cannot be inferred from this patent.

The German Offenlegungsschrift 2,017,306 discloses an apparatus essentially for materially reducing the width of metallic slabs, and comprises a pair of processing tools, which work in the plane of the slab and which lay hold of the slab at opposite edges. A strong pressing force, by means of which the width of the slab is reduced, is generated by a hydraulic drive, which is connected with each of the processing tools. So that a slab can be produced with the desired thickness, the relative distance between the processing tools is controlled by an adjusting device, which is connected with each processing tool. In order to suppress local thickenings of the workpiece while the width of the slab is being reduced by upsetting, the slab is held in a plane perpendicular to the plane of the pressing tools by a piston disposed above and a piston below the slab. The relative distance between the pistons and between each piston and the slab surface is variable. This previously known upsetting press works discontinuously in that, to begin with, the slab is clamped between the pistons and subsequently the horizontally acting pressing tools act on the edges of the slab to reduce its width.

At their metallic surface, the slabs in the upsetting press still have temperatures of about 800° C. and above. This means that, in the case of a continuously operating upsetting press, the holding-down devices, which are to suppress local thickenings of the slab during the upsetting process, must lie permanently on the surface of the slab and are exposed there to high temperatures. For this reason, they must be cooled. Random water cooling of the holding-down devices cannot be used because the cooling water cannot drain away due to the lateral thickening of the slab during lateral upsetting; and an evaporating area of water is formed on the surface of the slab and leads to strong, uncontrolled local cooling. Different local cooling of the slab not only have a negative effect on the upsetting process of the slab in the upsetting press, they also have increasingly negative effects in the subsequent horizontal frameworks to reduce the thickness of the rolled stock.

SUMMARY OF THE INVENTION

Accordingly, it is an object of the invention to protect the conveying devices and the holding-down devices for the glowing hot slab, which come into contact permanently with the hot surface of the slab particularly in the case of a continuously operating upsetting press, against the effects of high temperatures resulting from the direct transmission and the radiation of heat and to avoid local cooling of the slab during the upsetting process.

Pursuant to this object, and others which will become apparent hereafter, one aspect of the present invention resides in that in the region between the pressing tools, the upsetting press has at least one height-adjustable retaining roll above and at least one below the slab. Driver rolls are disposed in the inlet and outlet regions of the upsetting press above and below the slab and the retaining rolls and driver rolls are provided with internal cooling. By these means, the slab can be guided continuously and forcibly through the upsetting press. During the upsetting, local material thickenings, particularly those formed in the middle of the slab, are avoided. As a result of the internal cooling of the retaining rolls and the driver rolls, no cooling water reaches the slab during the upsetting process. Nevertheless, the temperature at the surface of the rolls can be held at about 550° to 650° C., that is, below the maximum permissible temperature at which danger to the roll material and the bearings of the rolls can be excluded. With the help of the internal cooling of the retaining rolls and the driver rolls, excessive local cooling of the slab is also avoided, which is the case with direct water cooling. The result of the above thus leads to greater operational safety of the machine elements in the upsetting press guiding the slab and to a more uniform and impact-reduced upsetting process between the pressing tools as well as between the rolls of the downstream horizontal roll stands.

In a further embodiment of the invention, the bearing housings of the retaining roll and the driver roll and, in particular, the cap pieces of the bearing housings, which point to the surface of the slab, are additionally provided with an internal cooling system.

In a particularly advantageous refinement of the internal cooling system of the retaining roll and the driver roll consists, in each of these rolls, cooling ducts are disposed with truly axial inlet and outlet ducts and with a plurality of horizontal ducts, which extend peripherally in the circumferential region of the rolls and essentially parallel to the pull-off surfaces of the rolls, as well as with connecting ducts between the inlet or outlet ducts and the horizontal ducts. In this manner, the heat from the surface of the rolls is preferentially transported away by the coolant stream and the selected arrangement of all cooling ducts causes the coolant to flow uniformly through all internal parts of the rolls, so that these are cooled uniformly.

A further embodiment of the invention provides that the retaining roll comprises at least one internal hub part, which is provided with bearing journals, and one external, hollow cylindrical roller, which can be connected with the hub part. On the outside of the hub part and the inside of the roller, ring grooves are provided from which connecting ducts to the horizontal ducts or to the inlet and outlet ducts branch off. If, because of the selection of material, for design reasons or from manufacturing considerations, the retaining roll or also the driver roll have to be constructed in several parts, the internal cooling of the rolls is equally ensured with the solution proposed here.

According to a different embodiment of the invention, the lower driver roll the inlet region of the upsetting press and the upper and lower driver rolls in the outlet region of the upsetting press are driveable. So that the driven driver roll also has a satisfactorily functioning internal cooling system, the inlet and outlet ducts for the coolant are advantageously constructed as a spaced double pipe, which is opposite the driven side and extends truly axially, the inner pipe being the inlet duct and the outer pipe the outlet duct, which is connected in each case over connecting ducts with the horizontal ducts. In this manner the coolant can be supplied by the shortest route to the peripheral horizontal ducts which cool the roll surface. The double-pipe arrangement thus also permits the driven driver roll to be cooled satisfactorily.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings. The invention is described in greater detail in the following by means of examples, it being understood that the examples are given by way of illustration and not by way of limitation.

DETAILED DESCRIPTION OF THE PREFERRED EMBODIMENTS

The upsetting press, which is not shown in detail and to which the upper and lower retaining rolls and the driver rolls that are provided with an internal cooling system belong, is an overhung upsetting press for reducing the width of slabs in a hot-rolled wide strip roughing mill. The slabs are supplied almost continuously from a slab casting installation, which precedes the upsetting press. The upsetting press has horizontal frame stands, and a crankcase, which accommodates the crank gear, is guided adjustably in the frame stand. The crankcase is adjusted with the help of a mechanical adjustment. Pressing tools are disposed on either side of the slab. The pressing tool has a crank gear, which acts—so to say—perpendicularly to the slab and a feed driving mechanism, which acts in the tangential direction parallel to the slab. The synchronization of the movements of the crank gear and the feed drive take place according to the feed motion of the slab. In rapid sequence, the pressing tool is adapted to the feed speed of the slab, is touched down perpendicularly to the slab edge (without motion relative to the slab), upsets the slab laterally and is then retracted laterally to a distance from the slab.

Figure 1:
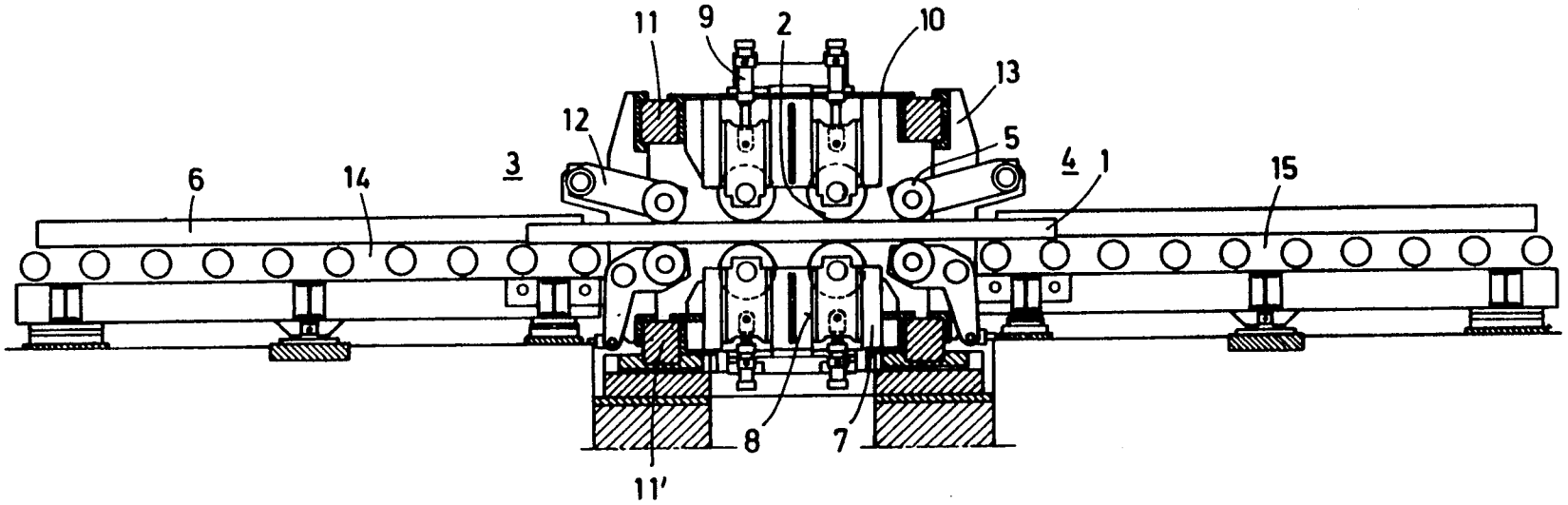
FIG. 1 shows a partial section of an upsetting press pursuant to the invention with retaining and driver rolls disposed above and below the slab.

FIG. 1 shows that the upsetting press has height-adjustable retaining rolls 2, which are disposed in the region between the pressing tools above and below the slab 1. Driver rolls 5 are disposed in the inlet region 3 and in the outlet region 4 of the upsetting press above and below the slab and the retaining rolls 2 and the driver rolls 5 are provided with an internal cooling system, which is shown in greater detail in FIGS. 2 and 3. The two retaining rolls 2 are disposed approximately centrally to the width direction of the slab and behind one another, as seen from the feed direction 6 of the slab, and are held height-adjustably in a holding frame 7 and vertical guides 8. The holding frame 7 and the adjusting device 9 for shifting the height of the retaining rolls 2 are connected with a transverse tie-bar 10, which in each case lies firmly on the upper or the lower spar 11, 11' of the horizontal frame stand of the upsetting press. The driver rolls 5 are held in a swivel arm 12, the pivot pin of which is disposed on a vertical tie-bar 13. The vertical tie-bar 13 is bolted tightly to the upper spar 11 and the lower spar 11' of the frame stand and in each case lies laterally outside of the inlet roller table 14 or the outlet roller table 15 for the slab 1. In the inlet region of the upsetting press, the lower drive roller 5 can be driven and, in the outlet region of the upsetting press, the upper as well as the lower driver rolls can be driven. The details of the driving systems for these rolls, such as the drive shafts, gearing and electrical motors, are not shown. With the help of the driver rolls 5 in the inlet and outlet regions of the upsetting press, the slab 1 is passed continuously and at a controllable speed through the press and, with that, through the action region of the pressing tools. With the help of the retaining rolls 2 lying above and below on the surface of the slab, a thickening or deflection of the slab upwards or downwards is avoided. However, this implies that the retaining rolls 2 as well as the driver rolls 5 are moved permanently and partially with considerable pressure against the hot surface of the slab 1, which still has a temperature of about 1050° to 1280° C., and roll off there. So that the slab 1 maintains as uniform a temperature as possible and, with that, the retaining rolls 2 and the driver rolls 5 are protected against the heat transferred on contact with the slab 1 and against the heat radiating from the slab 1, the rollers 2, 5 are provided with an internal cooling system, the configuration of which is described below.

Figure 2:
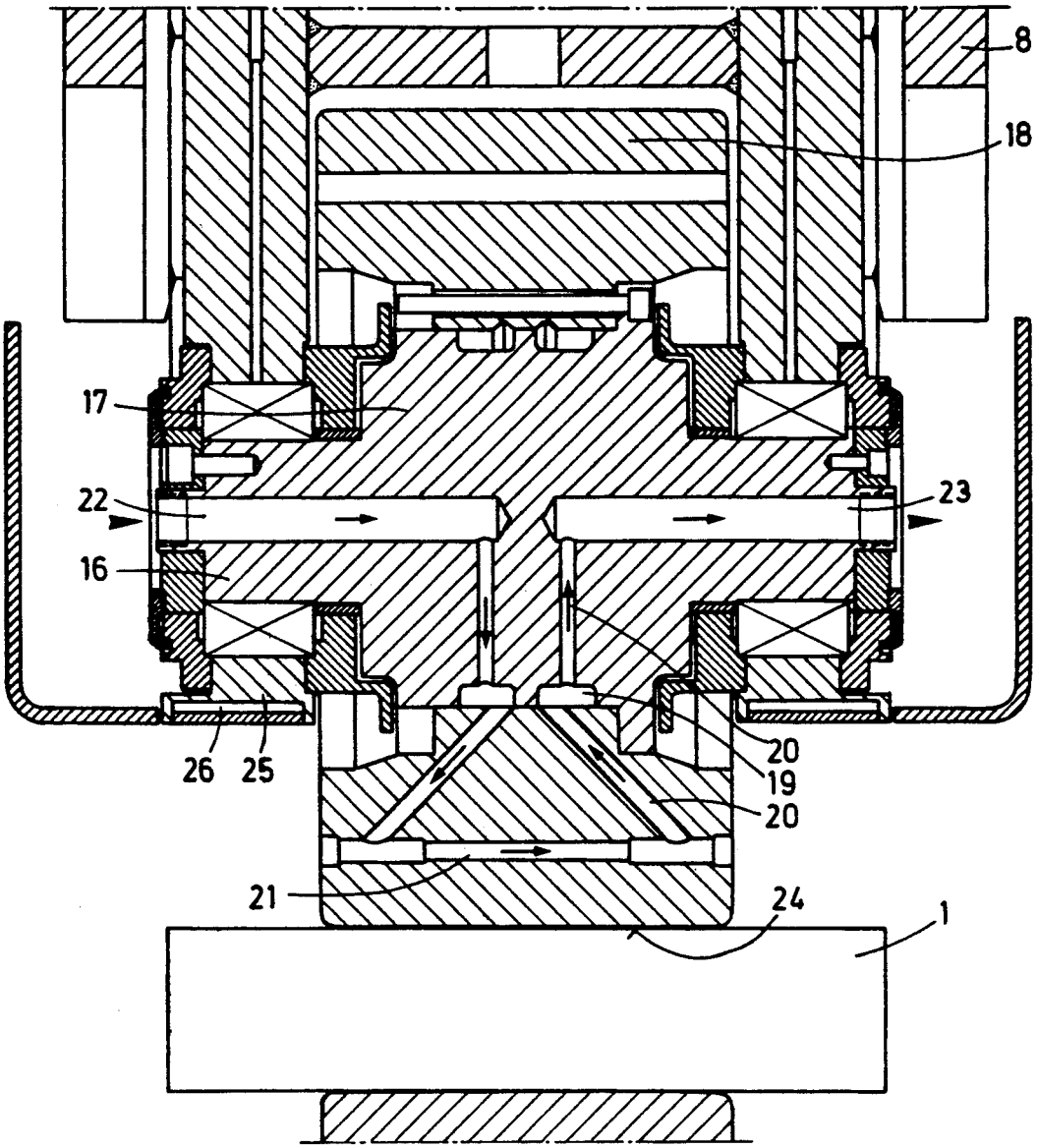
FIG. 2 shows the internal cooling system for a retaining roll, including the internal cooling system of the cap piece of the bearing.

FIG. 2 shows a retaining roll 2, which comprises an inner hub part 17 that is provided with a bearing journal 16 and an outer hollow, cylindrical roller 18, which can be connected with the hub part 17. The hub part 17 has external ring grooves 19 or the roller can have internal ring grooves. Connecting ducts 20 to the horizontal ducts 21 or to the inlet ducts 22 and outlet ducts 23, branch off from these ring grooves 19. The inlet ducts 22 and the outlet ducts 23 extend truly axially. A majority of the horizontal ducts 21 are distributed uniformly peripherally in the circumferential region of the rolls and are disposed essentially parallel to the discharge surface 24. Moreover, the bearing housings of the retaining roll 2, particularly the cap pieces 25 of the bearing housings, which point to the surface of the slab 1, are additionally provided with an internal cooling system, which, in the present case is formed into a longitudinally constructed cooling pocket 26. Details of the connections for the coolant are not shown. The coolant flows through the cooling ducts in the direction of the arrows shown. The cooling system for the retaining roll 2 and the cooling system for the bearing housing or the cap piece 25 of the bearing of the retaining roll are connected with one another through pipes. Details of the pipes are not shown, but could correspond to conventional pipeline construction. It can be seen that, with such an arrangement of coolant ducts, an optimum internal cooling of the retaining rolls 2, particularly of the pull-off surfaces of the retaining rolls 2, which are in contact with the slab surface that is at a high temperature, is ensured.

Figure 3:
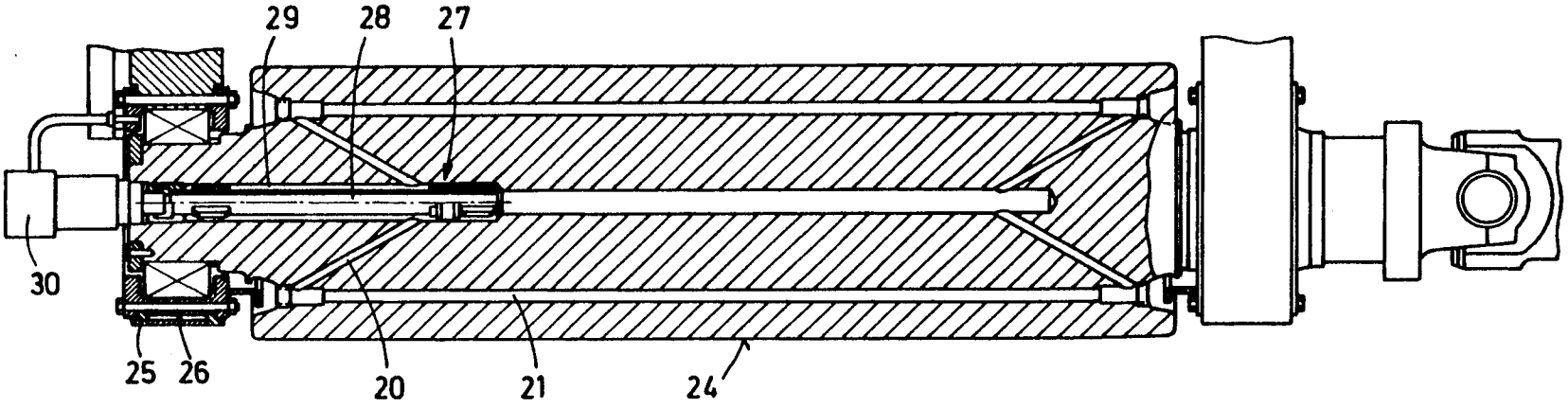
FIG. 3 shows the internal cooling system of a driver roll with a double pipe inflow and outflow for the coolant.

FIG. 3 shows the construction of the coolant ducts in the driven driver roll 5. The inlet and outlet ducts 22, 23 are constructed as a spaced double pipe 27, which is opposite the driven side and extends truly axially, the inner pipe 28 being the inlet duct and the outer pipe 29 the outlet duct, which is connected in each case over connecting ducts 20 with the horizontal ducts 21. As in the case of the retaining roll 2, the cap pieces of the bearings 25 are provided with an internal cooling system, which is constructed as a cooling pocket 26. The cooling pocket is 26 supplied with coolant over the coolant connection 30, from which a pipe connection to the cap piece of the bearing 25 branches off. It can be seen that, particularly with the horizontal ducts 21 that are disposed in the circumferential region of the driver roll 25, very good and uniform cooling of the corresponding pull-off surfaces of the roll, which constantly come into contact with the surface of the slab that is at a high temperature, becomes possible.

With the help of the measures described above, the objective of the invention is achieved to the fullest extent, in that the deflection or arching of the slab during a continuously carried out width reduction is avoided and uncontrolled local cooling of the slab is prevented. Such uncontrolled local cooling would always occur if, instead of the inventive internal cooling of the retaining rolls and the driver rolls, an open type of water cooling would be carried out.

While the invention has been illustrated and described as embodiment in an upsetting press for reducing the width of rolling stock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An upsetting press for reducing the slab width of rolling stock in hot-rolled wide strip roughing mills, comprising:

tool carriers disposed on either side of the slab edge to accommodate pressing tools so that the tools face one another;

at least one height-adjustable retaining roll (2) above and at least one height-adjustable retaining roll (2) below the slab (1) in a region between the pressing tools;

a plurality of driver rolls (5) arranged in inlet and outlet regions (3, 4) of the upsetting press above and below the slab;

means for internally cooling the retaining rolls (2) and driver rolls (5), the cooling means including cooling ducts (20–23) disposed in each retaining roll (2) and in each driver roll (5), which cooling ducts include axially true inlet and outlet ducts (22,23) and a plurality of horizontal ducts (21), which horizontal ducts extend peripherally in a circumferential region of the retaining and driver rolls (2, 3) and essentially parallel to pull-off surfaces (24) of the retaining and driver rolls, the cooling ducts further including connecting ducts (20) arranged between the inlet or outlet ducts (22,23) and the horizontal ducts (21), at least each retaining roll (2) having an internal hub part (17), which is provided with bearing journals (16), and an external, hollow, cylindrical roller (18), which is connectable with the hub part, ring grooves (19) being provided on one of an external portion of the hub part and an internal portion of the roller (18), the connecting ducts (20) branching off the ring grooves to one of the horizontal ducts (21) and the inlet and outlet ducts (22,23), the inlet and outlet ducts for at least each driver roll (5) are constructed as a spaced double pipe (27), which is opposite a driven side of the driver rolls (5) and extends axially true, an inner pipe (28) of the double pipe being the inlet duct and an outer pipe (29) of the double pipe being the outlet duct, which is connected in each case by the connecting ducts (20) with the horizontal ducts (21), the retaining rolls (2) and the driver rolls (5) having bearing housings with cap pieces (25) which point to a surface of the slab; and additional cooling means for internally cooling the bearing housings and cap pieces which point to the slab surface, both of the cooling means including a coolant supply, the coolant supply of the cooling means for the retaining rolls (2) and for the driver rolls (5) being connected with the coolant supply of the additional cooling means for the bearing housing and cap piece (25).

* * * * *